US011009287B2

(12) United States Patent
Kim et al.

(10) Patent No.: US 11,009,287 B2
(45) Date of Patent: May 18, 2021

(54) REFRIGERATOR

(71) Applicant: SAMSUNG ELECTRONICS CO., LTD., Suwon-si (KR)

(72) Inventors: Sung Mo Kim, Ansan-si (KR); Po Cheon Kim, Suwon-si (KR); Dong Won Koo, Seoul (KR); Woo Chul Cho, Suwon-si (KR); Sun Hwan Joo, Suwon-si (KR); Oun Gu Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/321,161

(22) PCT Filed: Jul. 28, 2017

(86) PCT No.: PCT/KR2017/008146

§ 371 (c)(1),
(2) Date: Jan. 28, 2019

(87) PCT Pub. No.: WO2018/021863

PCT Pub. Date: Feb. 1, 2018

(65) Prior Publication Data

US 2019/0170429 A1 Jun. 6, 2019

(30) Foreign Application Priority Data

Jul. 28, 2016 (KR) ..... 10-2016-0096488

(51) Int. Cl.
*F25D 23/04* (2006.01)
*F25D 23/02* (2006.01)
(Continued)

(52) U.S. Cl.
CPC ..... *F25D 23/028* (2013.01); *F25D 11/02* (2013.01); *F25D 23/04* (2013.01); *F25D 29/005* (2013.01);
(Continued)

(58) Field of Classification Search
CPC ..... F25D 11/00; F25D 11/02; F25D 23/00; F25D 23/025; F25D 23/028; F25D 23/12;
(Continued)

(56) References Cited

U.S. PATENT DOCUMENTS 6,231,146 B1 * 5/2001 Dang ..... F25D 23/04 312/321.5
10,563,906 B2 * 2/2020 Yeh ..... G03B 17/561
(Continued)

FOREIGN PATENT DOCUMENTS

CA 2421050 * 2/2002
CN 105605879 5/2015
(Continued)

OTHER PUBLICATIONS

KR 2006099985; Yang; abstract and figure (Year: 2006).*
(Continued)

*Primary Examiner* — Janet M Wilkens
(74) *Attorney, Agent, or Firm* — Staas & Halsey LLP

(57) ABSTRACT

The refrigerator includes a main body having a storage room, a door for opening and closing the storage room, and a camera device having a plurality of cameras for photographing the storage room and mounted on the inner surface of the door. The state of the storage room can be checked without opening the door by the camera device.

10 Claims, 15 Drawing Sheets

(51) Int. Cl.
*F25D 29/00* (2006.01)
*F25D 11/02* (2006.01)

(52) U.S. Cl.
CPC ..... *F25D 2400/36* (2013.01); *F25D 2700/06* (2013.01)

(58) Field of Classification Search
CPC ..... F25D 23/04; F25D 25/005; F25D 29/005; F25D 29/00; F25D 2400/36; F25D 2700/06; F25D 23/06; F25D 29/003; F25D 27/00; G03B 29/00; G03B 17/561; H04N 7/183; H04N 5/2256
USPC ..... 312/401, 405, 405.1, 321.5
See application file for complete search history.

(56) References Cited

U.S. PATENT DOCUMENTS

| | | | | |
|---|---|---|---|---|
| 10,641,543 | B2 * | 5/2020 | Yeh | G03B 17/561 |
| 2004/0108798 | A1 * | 6/2004 | Laible | F25D 23/065 312/405 |
| 2006/0096303 | A1 * | 5/2006 | Kavounas | F25D 29/00 62/125 |
| 2006/0186775 | A1 * | 8/2006 | Becke | F25D 23/04 312/405.1 |
| 2014/0293060 | A1 * | 10/2014 | Ryu | F25D 29/00 348/159 |
| 2015/0059374 | A1 * | 3/2015 | Hebei | F25D 29/00 62/125 |
| 2015/0211783 | A1 * | 7/2015 | Marutani | F25D 23/02 62/125 |
| 2016/0057394 | A1 * | 2/2016 | Marutani | F25D 23/04 348/143 |
| 2016/0080705 | A1 * | 3/2016 | Jain | H04N 7/188 348/152 |
| 2016/0084560 | A1 * | 3/2016 | Jeong | F25D 11/02 62/344 |
| 2016/0201974 | A1 * | 7/2016 | Grimminger | F25D 29/00 312/405.1 |
| 2016/0282038 | A1 * | 9/2016 | Daniel | F21V 33/0044 |
| 2017/0041520 | A1 * | 2/2017 | Carlotto | H04N 5/2252 |
| 2017/0219276 | A1 * | 8/2017 | Wang | F25D 29/00 |
| 2017/0234602 | A1 * | 8/2017 | Seo | F21V 33/00 348/151 |
| 2017/0263100 | A1 * | 9/2017 | Johnston | F25D 29/008 |
| 2018/0202709 | A1 * | 7/2018 | Chen | F25D 29/005 |
| 2018/0245840 | A1 * | 8/2018 | Chen | H04N 5/2257 |
| 2018/0372394 | A1 | 12/2018 | Kim et al. | |
| 2019/0031302 | A1 * | 1/2019 | Nutz | B63B 35/71 |
| 2019/0072322 | A1 * | 3/2019 | Murata | F25D 29/00 |
| 2019/0113271 | A1 * | 4/2019 | Yeh | G03B 29/00 |
| 2020/0003484 | A1 * | 1/2020 | Yamade | F25D 29/005 |
| 2020/0173717 | A1 * | 6/2020 | Du | F25D 23/021 |

FOREIGN PATENT DOCUMENTS

| | | | |
|---|---|---|---|
| CN | 105074365 | | 11/2015 |
| DE | 102015213780 | * | 1/2017 |
| JP | 2006-46771 | | 2/2006 |
| JP | 2014-238218 | | 12/2014 |
| JP | 2015-45447 | | 3/2015 |
| JP | 2016-61556 | | 4/2016 |
| JP | 3219453 | * | 12/2018 |
| KR | 10-2006-0099985 | | 9/2006 |
| KR | 10-2014-0120386 | | 10/2014 |
| KR | 10-2015-0128901 | | 11/2015 |
| WO | 2014156051 | * | 2/2014 |
| WO | 2014198628 | * | 12/2014 |
| WO | 2015029824 | * | 3/2015 |
| WO | 2018/128378 | | 7/2018 |
| WO | 2018212493 | * | 11/2018 |
| WO | 2018216234 | * | 11/2018 |
| WO | 2019057548 | * | 3/2019 |
| WO | 2019150636 | * | 8/2019 |
| WO | 2018092310 | * | 9/2019 |

OTHER PUBLICATIONS

International Search Report dated Oct. 16, 2017 in corresponding International Patent Application No. PCT/KR2017/008146.
Written Opinion of the International Searching Authority dated Oct. 16, 2017 in corresponding International Patent Application No. PCT/KR2017/008146.
Korean Office Action dated Jan. 9, 2019 in corresponding Korean Patent Application No. 10-2016-0096488.
Extended European Search Report dated Mar. 20, 2019 from European Patent Application No. 17834804.1, 8 pages.
Korean Office Action dated May 24, 2019 from Korean Patent Application No. 10-2016-0096488, 11 pages.
Indian Office Action dated Dec. 2, 2019 from Indian Patent Application No. 201817032625, 6 pages.
Korean Office Action dated Nov. 5, 2019 from Korean Patent Application No. 10-2016-0096488, 6 pages.
Chinese Office Action dated Apr. 23, 2020 from Chinese Patent Application No. 201780032973.5, 20 pages.

* cited by examiner

[Fig. 1]
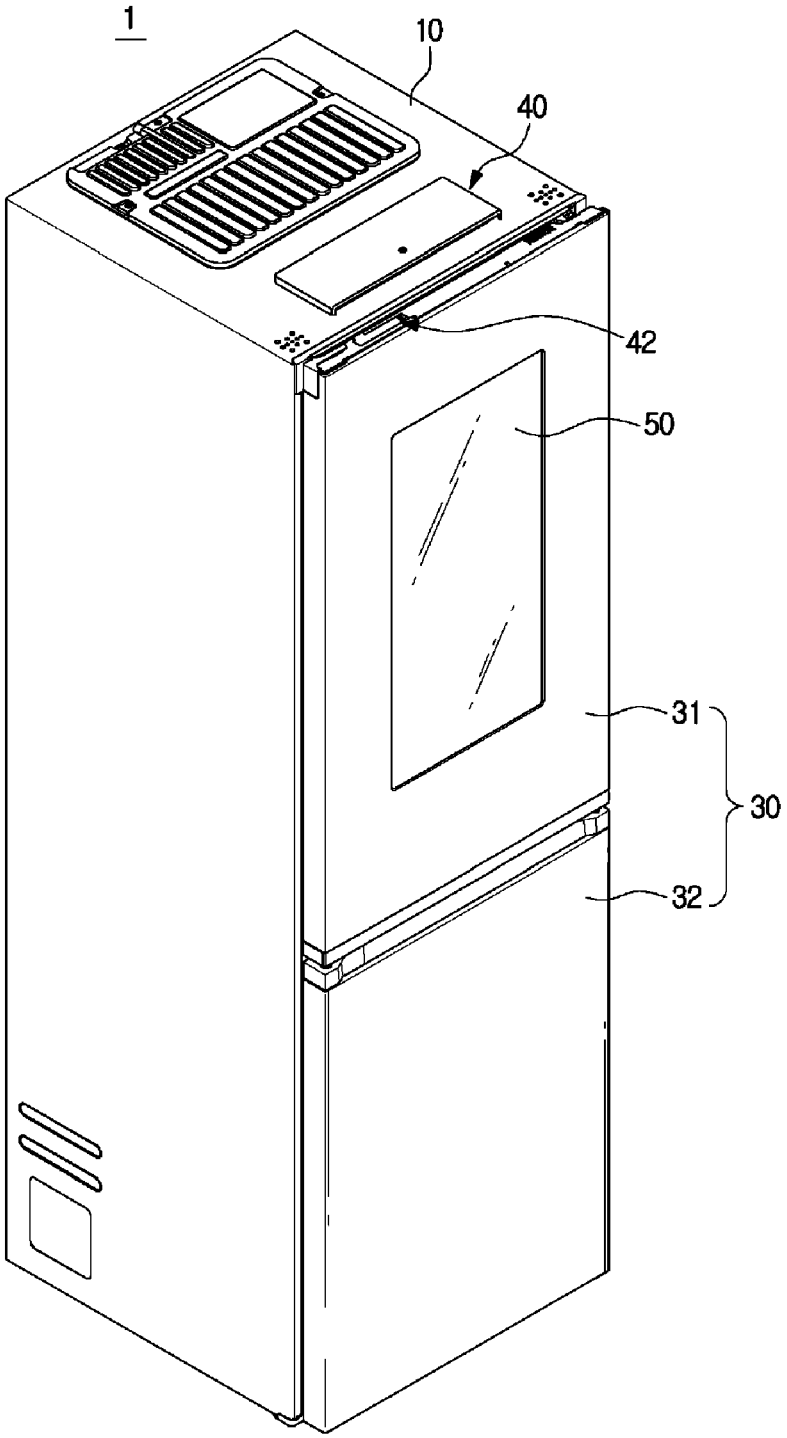

[Fig. 2]
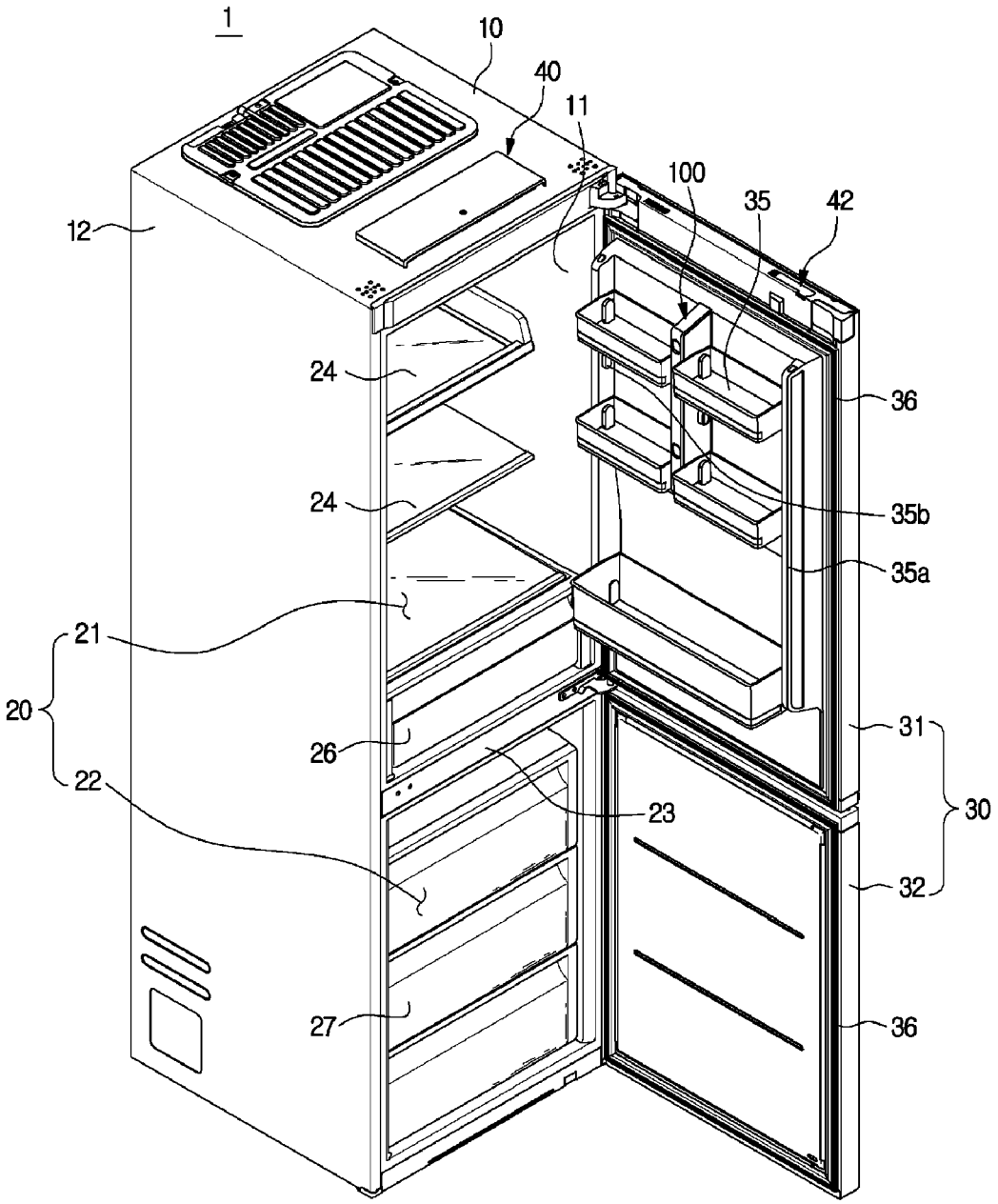

[Fig. 3]
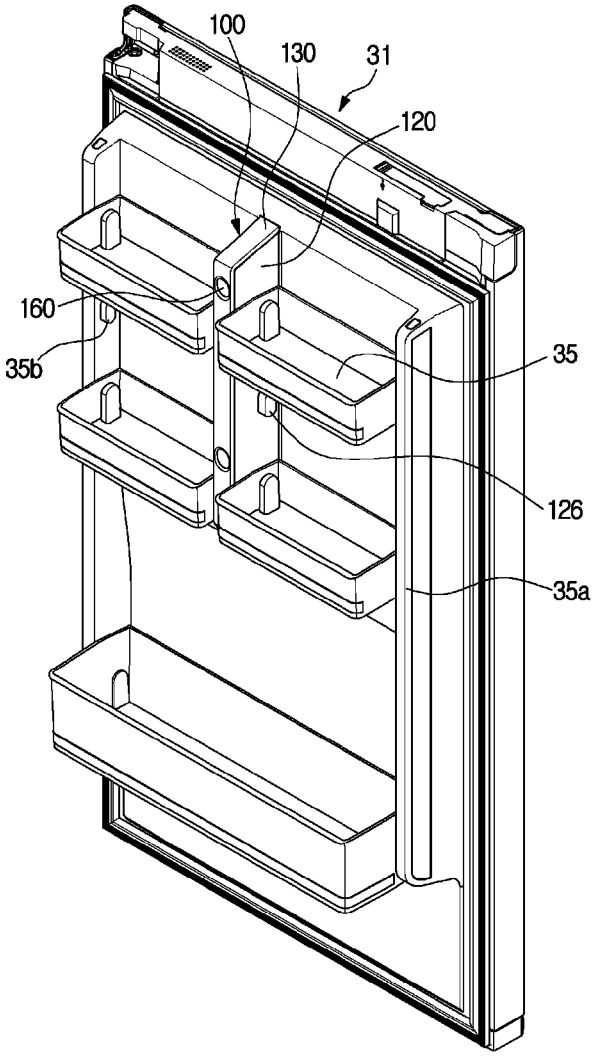

[Fig. 4]
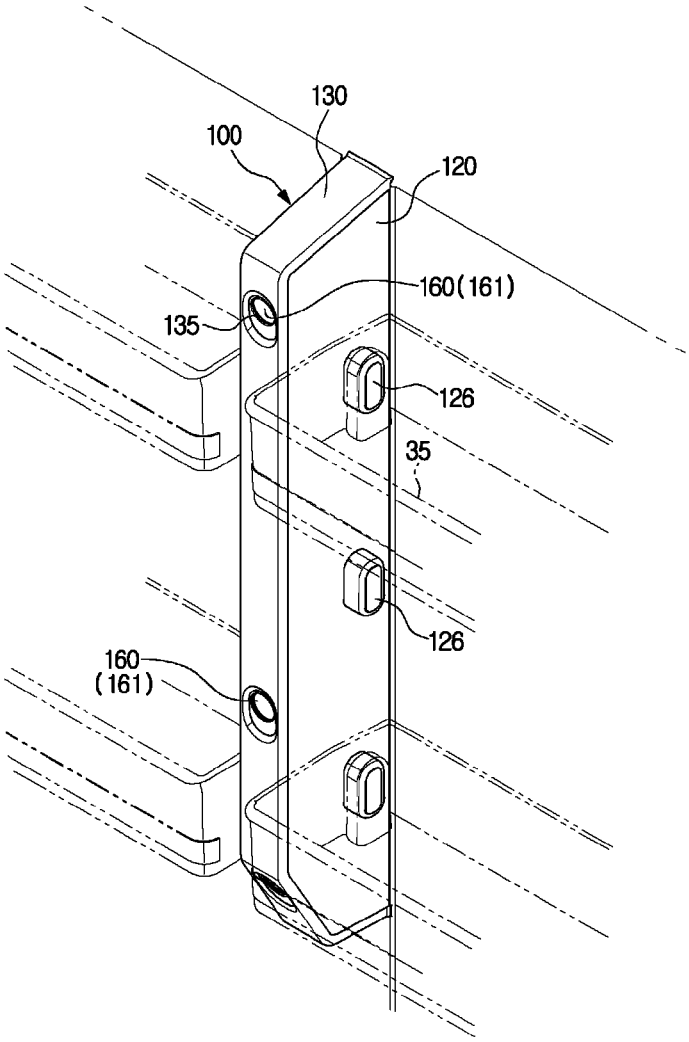

[Fig. 5]
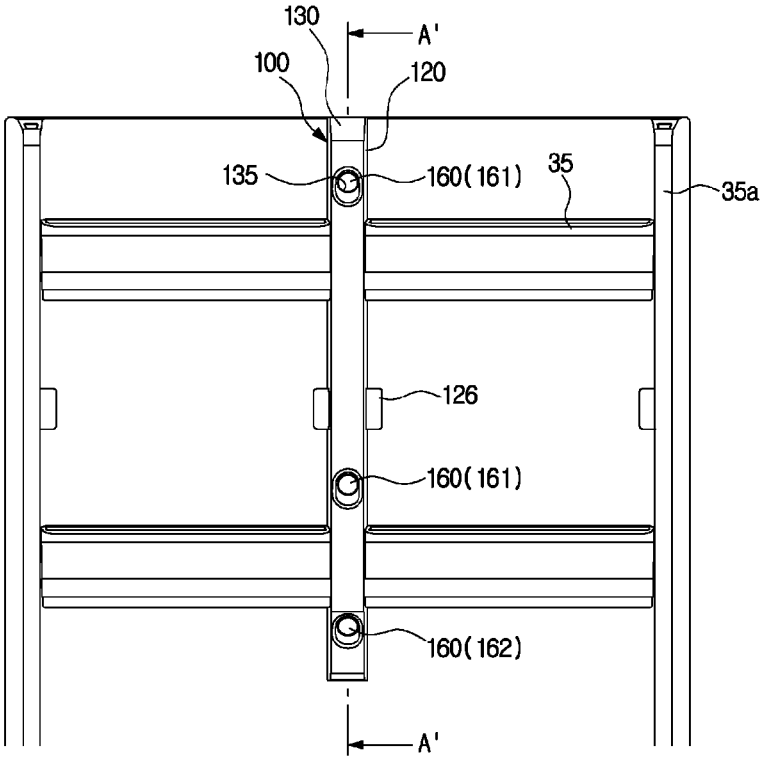

[Fig. 6]
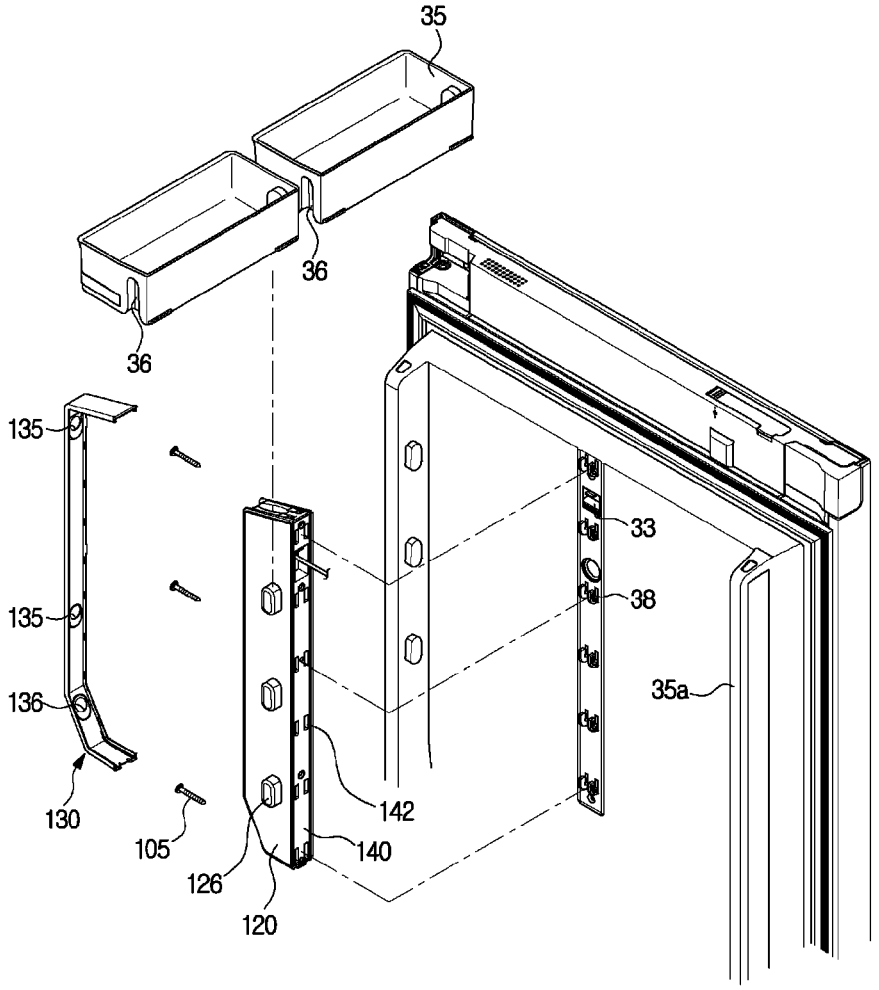

[Fig. 7]
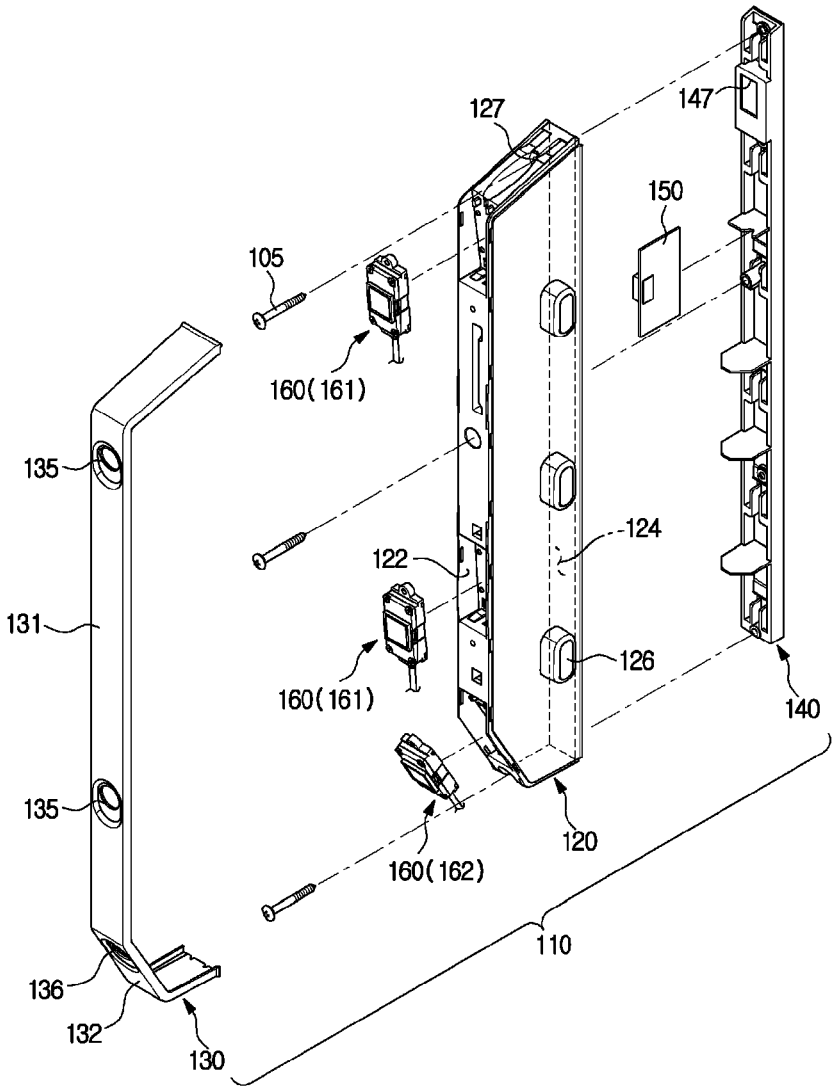

[Fig. 8]
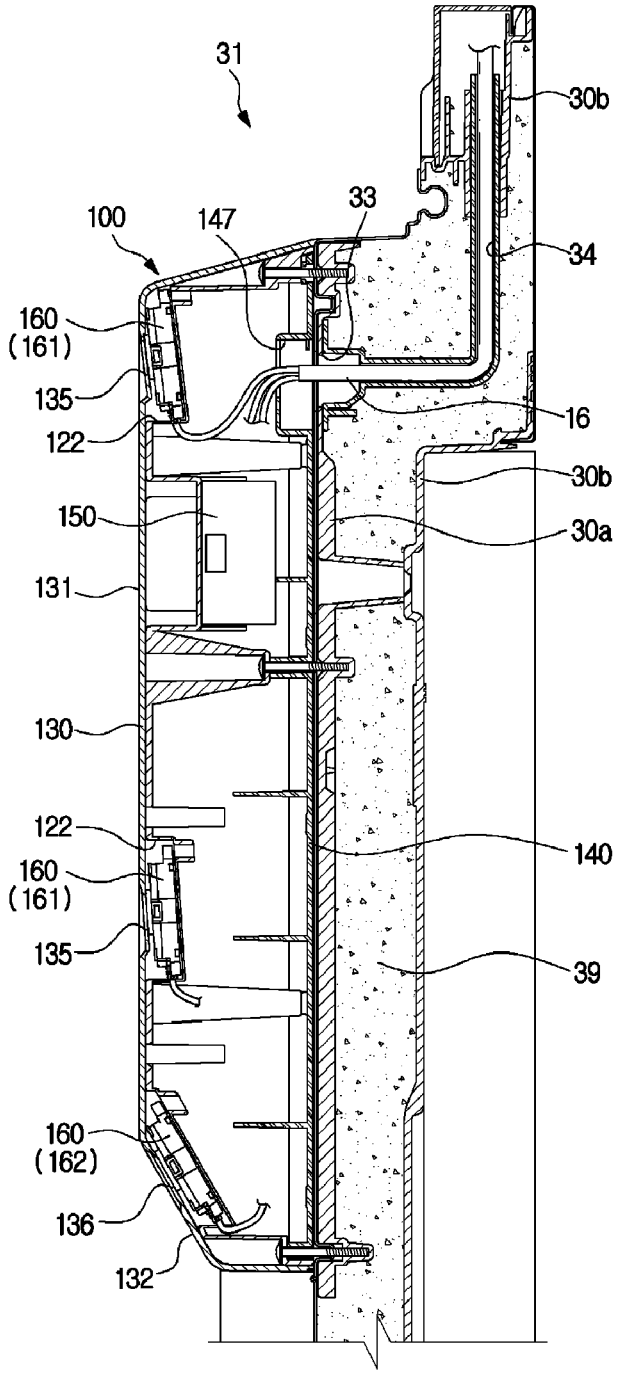

[Fig. 9]
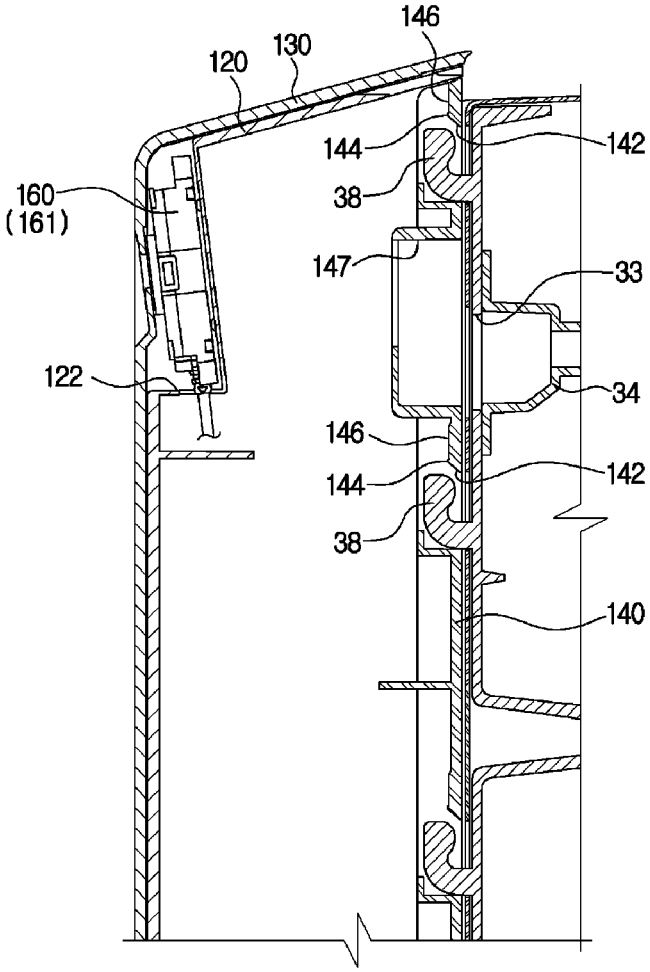

[Fig. 10]
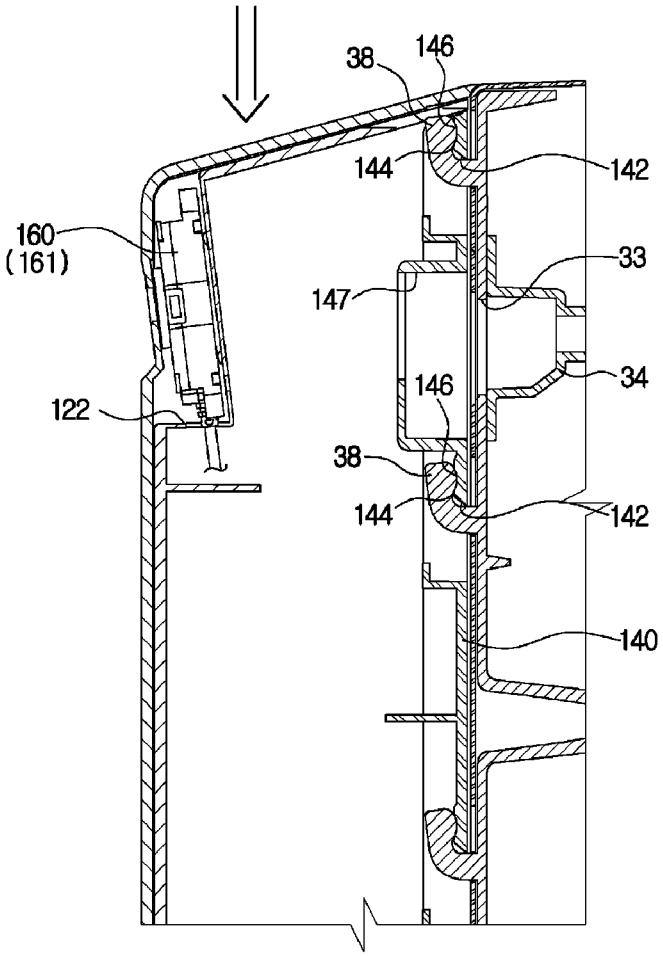

[Fig. 11]
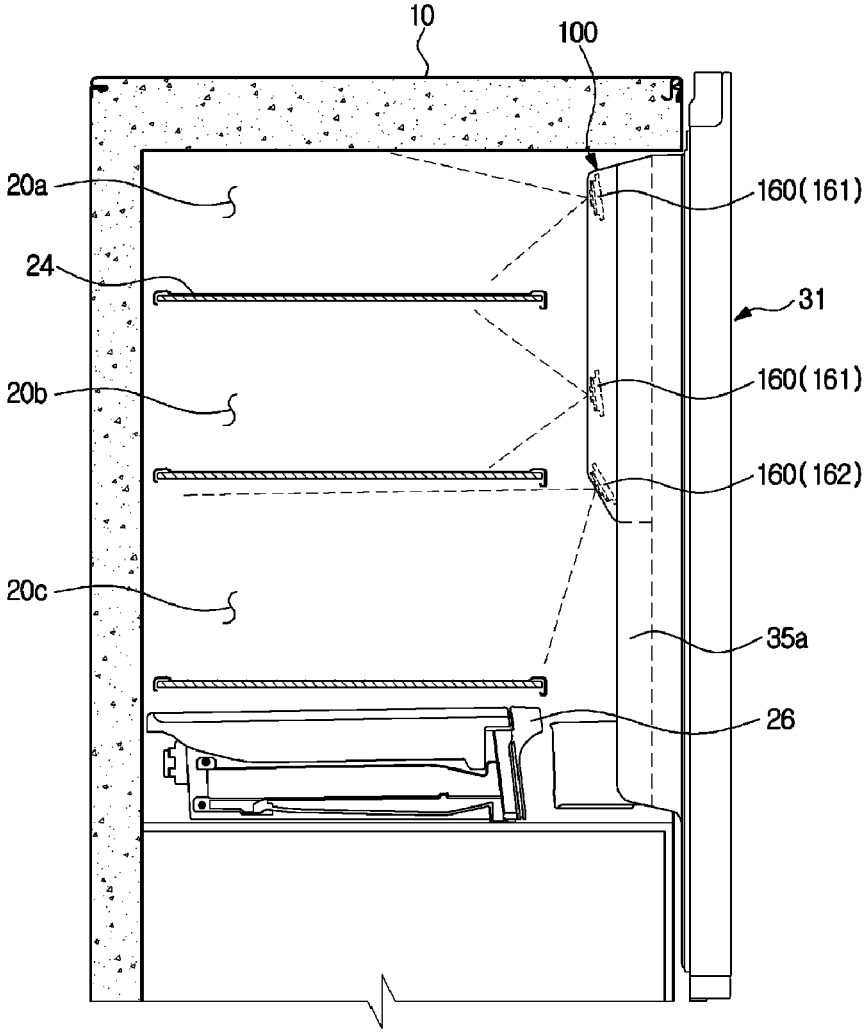

[Fig. 12]
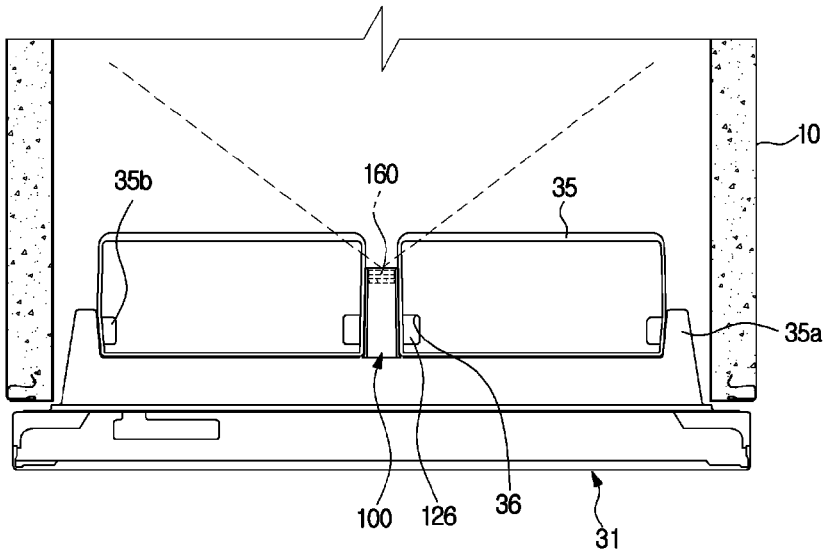

[Fig. 13]
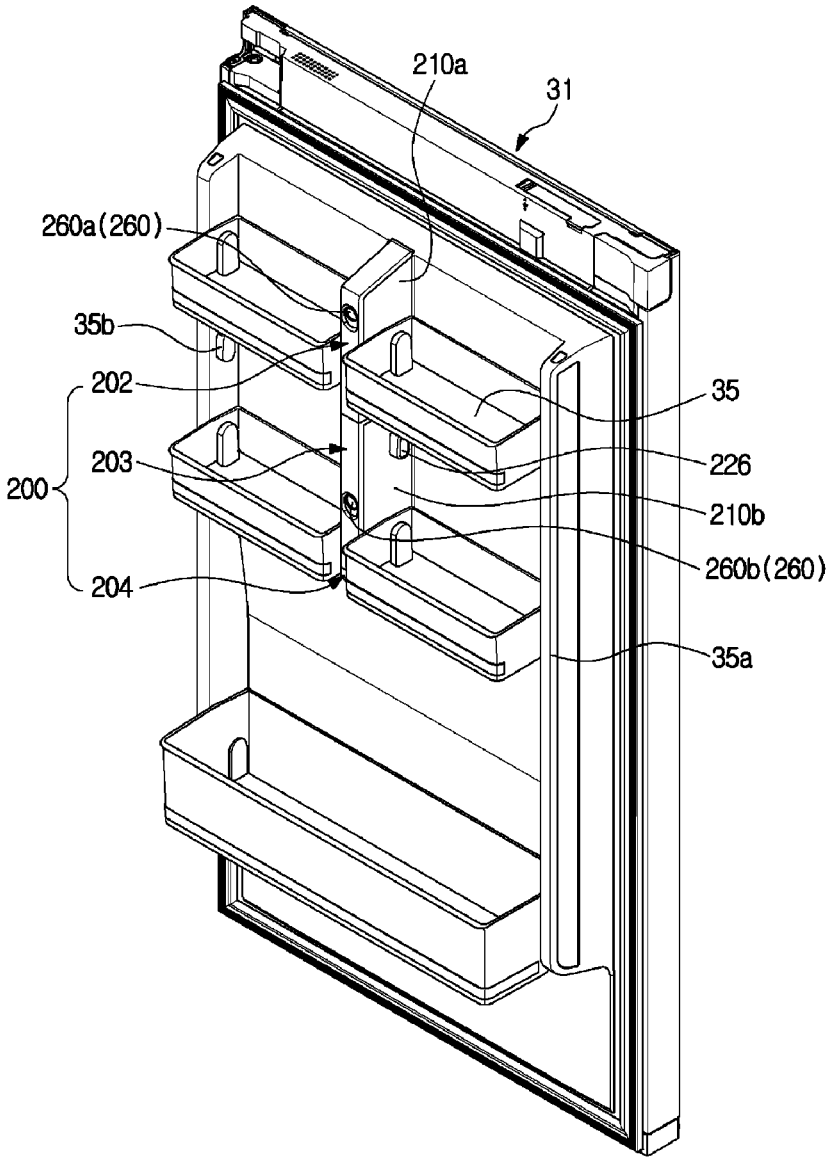

[Fig. 14]
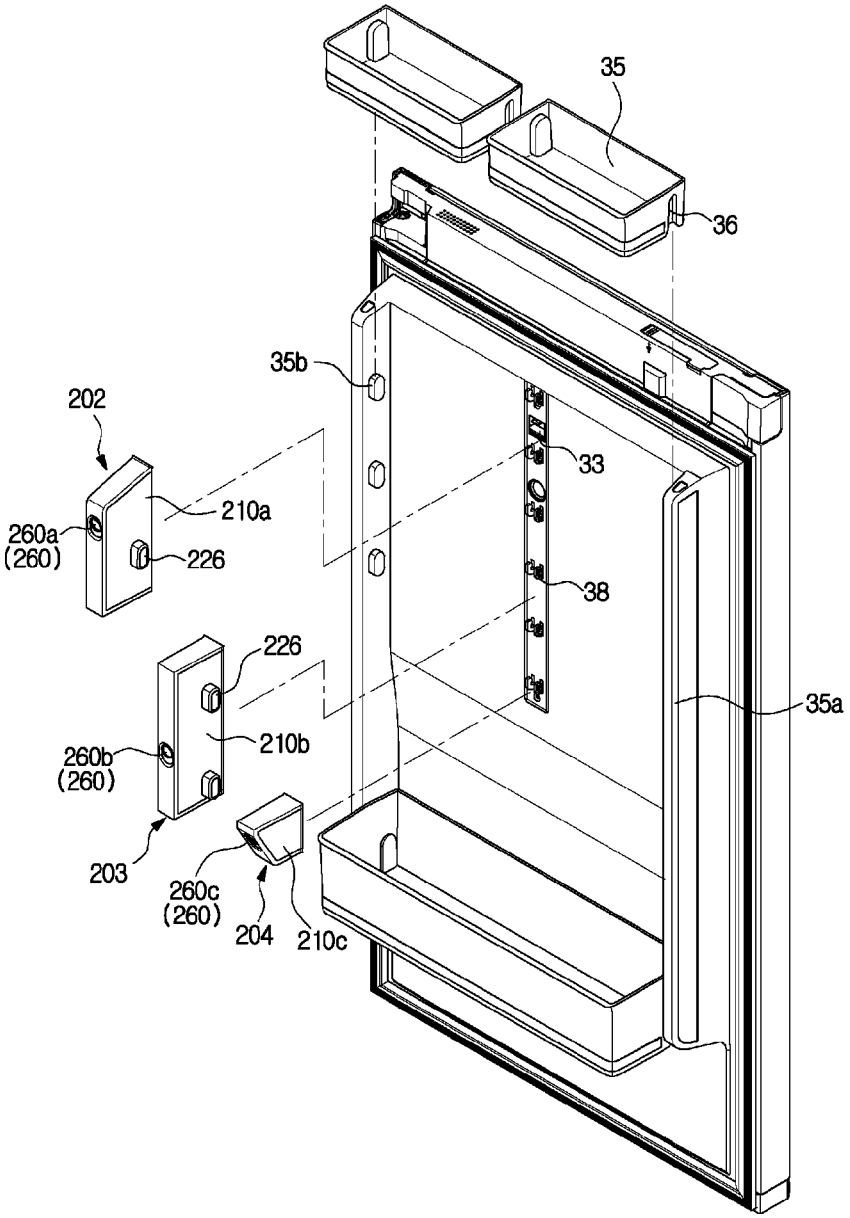

[Fig. 15]
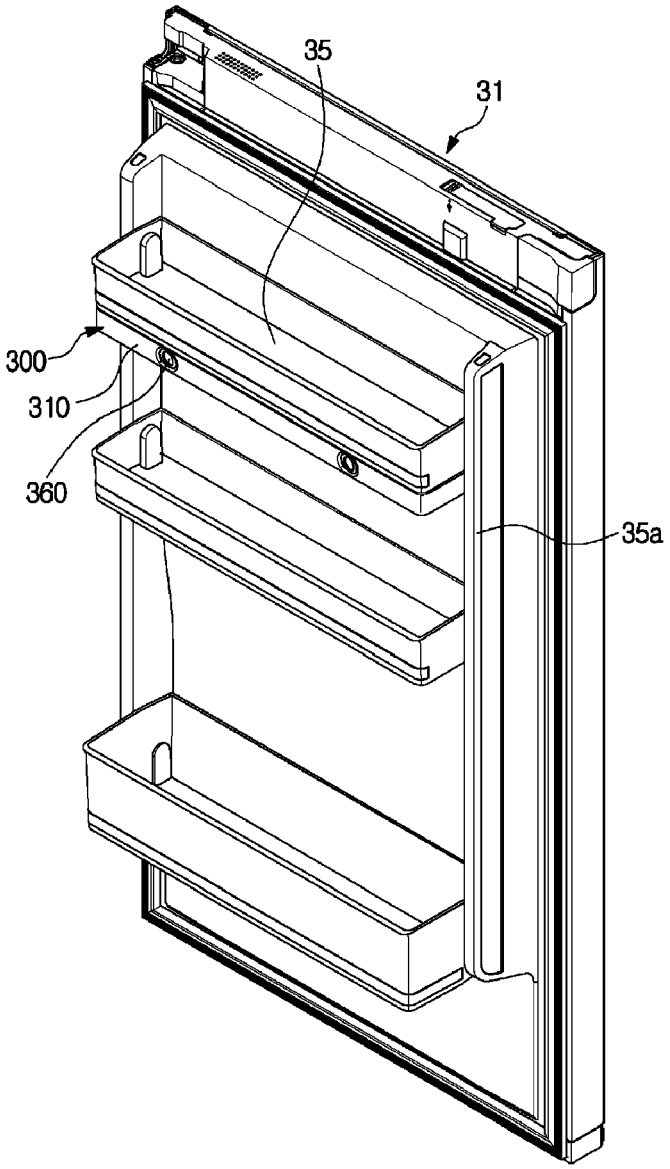

REFRIGERATOR

CROSS-REFERENCE TO RELATED APPLICATIONS

This application is a National Phase application which claims the benefit under 35 U.S.C. § 371 of International Patent Application No. PCT/KR2017/008146 filed Jul. 28, 2017 which claims the foreign priority benefit under 35 U.S.C. § 119 of Korean Patent Application No. 10-2016-0096488, filed Jul. 28, 2016, the disclosures of which are incorporated herein by reference.

TECHNICAL FIELD

The present invention relates to a refrigerator, and more particularly, to a refrigerator in which a camera device is mounted.

BACKGROUND ART

Generally, a refrigerator is a household appliance including a storage compartment configured to store food and a cold air supply device configured to supply cold air to the storage compartment to make it possible to keep the food fresh.

In the case of a conventional refrigerator, only a function of storing food in a low temperature state may be performed. However, recently, functions in addition to the function of storing food have increased in necessity.

Since a refrigerator is an apparatus configured to accommodate and store certain objects to be accommodated, a door of the refrigerator has to be opened to check the inside of the refrigerator. Further, in the case in which a user does not know an amount and type of food stored in a refrigerator when buying something from a market or a store, the user faces an inconvenience of making a redundant food purchase or being unable to buy necessary food.

DISCLOSURE

Technical Problem

One aspect of the present invention provides a refrigerator in which a storage compartment is recorded.

One aspect of the present invention provides a refrigerator in which a storage compartment is viewable from the outside.

One aspect of the present invention provides a refrigerator configured to adjust the number of cameras according to the way in which stored goods are loaded or an amount of the stored goods.

Technical Solution

In accordance with one aspect of the disclosure, the refrigerator includes a main body having a storage chamber, a door for opening and closing the storage chamber, and a camera device having a plurality of cameras for photographing the storage room and mounted on the inner surface of the door.

The camera device may be detachably mounted on the door.

The plurality of cameras may be configured to photograph different regions of the storage room.

The camera device may include a housing on which the plurality of cameras are mounted and detachably mounted on an inner surface of the door.

The housing may be formed in a vertical direction, and the plurality of cameras may be spaced apart from each other along the longitudinal direction of the housing.

The housing may be mounted to pass through the center of the width of the door.

The housing includes: a first surface extending in a vertical direction; And a second surface bent from the first surface and inclined toward an inner surface of the door. The plurality of cameras include at least one first camera configured to be photographable through the first surface; And at least one second camera configured to be photographable through the second surface.

The storage room includes a plurality of storage portions divided by at least one shelf, and the plurality of cameras can be mounted to the housing to face the plurality of storage portions, respectively.

The camera device may be slidably mounted on the inner surface of the door.

The door includes a holder formed to protrude from the inner surface of the door, and on which the camera device is mounted. The housing includes an insertion hole, into which the holder is inserted, formed in one surface facing the inner surface of the door and a holder seat portion disposed adjacent to the insertion hole, and configured so that the holder is seated thereon by the sliding movement of the camera device.

The door includes at least one door guard for receiving an object to be cooled. The camera device may further include: a housing in which the plurality of cameras are mounted and at least one guard holder provided on one side of the housing to support one side of the at least one door guard.

The plurality of cameras and the at least one door guard may be alternately arranged in the vertical direction.

The at least one door guard comprises a plurality of door guards located on either side of the camera device. The at least one guard holder may include a plurality of guard holders provided on both sides of the housing to support one side of the plurality of door guards.

The camera device may include a plurality of camera units mounted on at least one of the plurality of cameras and arranged in a vertical direction, and a plurality of camera units detachably mounted on the door.

The housing may be formed in a lateral direction, and the plurality of cameras may be spaced apart from each other along the longitudinal direction of the housing.

In accordance with one aspect of the disclosure, a refrigerator includes a main body having a storage chamber, a door for opening and closing the storage chamber and a camera device provided to photograph the storage room. The camera device comprises at least one camera and a housing to which the at least one camera is mounted and detachably mounted to the door.

The door includes a holder formed to protrude from the inner surface of the door, and on which the camera device is mounted. The housing includes an insertion hole, into which the holder is inserted, formed in one surface facing the inner surface of the door and a holder seat portion disposed adjacent to the insertion hole, and configured so that the holder is seated thereon by the sliding movement of the camera device.

In accordance with one aspect of the disclosure, the refrigerator includes a main body having a storage chamber, a door having at least one door guard for opening and closing said storage chamber, and a camera device having a housing mounted on the door and at least one camera mounted on the housing and photographing the storage room. The housing includes a guard holder for supporting one side of the at least one door guard.

The at least one camera and the at least one door guard may be vertically spaced from each other.

The housing may be removably mounted on the door.

Advantageous Effects

A refrigerator according to the present invention includes a camera device, and thus a storage compartment in the refrigerator can be viewed without opening a door.

Further, since images recorded by a camera device can be transmitted to a display provided in a refrigerator or a communication appliance, a state of the inside of the refrigerator can be easily checked.

Further, a state of a camera device can be changed according to user convenience.

DESCRIPTION OF DRAWINGS

FIG. 1 is a perspective view of a refrigerator according to one embodiment of the present invention.

FIG. 2 is a perspective view of the refrigerator according to one embodiment of the present invention, of which a door is open.

FIG. 3 is a perspective view of a refrigerator door according to one embodiment of the present invention.

FIGS. 4 and 5 are views showing a disposition of a camera device of the refrigerator according to one embodiment of the present invention.

FIGS. 6 and 7 are exploded perspective views of the camera device of the refrigerator according to one embodiment of the present invention.

FIG. 8 is a cross-sectional view of A-A' in FIG. 5.

FIGS. 9 and 10 are views in which the camera device of the refrigerator according to one embodiment of the present invention is mounted.

FIG. 11 is a view of a vertical view angle of the camera device of the refrigerator according to one embodiment of the present invention.

FIG. 12 is a view of a lateral view angle of the camera device of the refrigerator according to one embodiment of the present invention.

FIG. 13 is a perspective view of a refrigerator door according to another embodiment of the present invention.

FIG. 14 is an exploded perspective view of a refrigerator door according to another embodiment of the present invention.

FIG. 15 is a perspective view of a refrigerator door according to still another embodiment of the present invention.

MODES OF THE INVENTION

Embodiments described in the specification and configurations shown in the accompanying drawings are merely exemplary examples of the present invention, and various modifications may replace the embodiments and the drawings of the present invention at a time at which the present application is filed.

Further, identical symbols or numbers in the drawings of the present invention denote components or elements configured to perform substantially identical functions.

Further, terms used herein are only for the purpose of describing particular embodiments and are not intended to limit the present invention. The singular form is intended to also include the plural form, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," and the like may be used herein to describe various elements, the elements are not limited by the terms, and the terms are only used to distinguish one element from another. For example, a first element could be termed a second element, and similarly, a second element could be termed a first element without departing from the scope of the present invention. The term "and/or" includes combinations of one or all of a plurality of associated listed items.

Hereinafter, embodiments according to the present invention will be described in detail with reference to the accompanying drawings.

Generally, a refrigerator is a household appliance including a storage compartment configured to store food and a cold air supply device configured to supply cold air to the storage compartment to make it possible to keep the food fresh. The type of a refrigerator may be classified according to the type of storage compartment and the type of door.

A refrigerator includes a top mounted freezer (TMP) type refrigerator in which a storage compartment is vertically compartmentalized by a lateral partition, thus forming a freezer compartment at an upper side and a refrigerator compartment at a lower side, and includes a bottom mounted freezer (BMF) type refrigerator in which a refrigerator compartment is formed at an upper side and a freezer compartment is formed at a lower side.

Further, a refrigerator includes a side by side (SBS) type refrigerator in which a storage compartment is laterally compartmentalized by a vertical partition, thus forming a freezer compartment at one side and a refrigerator compartment at the other side, and includes a French door refrigerator (FDR) type refrigerator in which storage compartment is vertically compartmentalized by a lateral partition, thus forming a refrigerator compartment at an upper side and a freezer compartment at a lower side, the refrigerator compartment at the upper side being opened and closed by a pair of doors.

Meanwhile, a gasket is provided at a door of a refrigerator to seal a gap between the door and a main body when the door is closed.

A refrigerator in the embodiments is described as a BMF type refrigerator. However, although a BMF type refrigerator is described for convenience of description, the refrigerator is not limited thereto.

FIG. 1 is a perspective view of a refrigerator according to one embodiment of the present invention, and FIG. 2 is a perspective view of the refrigerator according to one embodiment of the present invention, of which a door is open.

A refrigerator 1 includes a main body 10 forming an exterior thereof, a storage compartment 20 formed to be vertically compartmentalized inside the main body 10, a door 30 configured to open and close the storage compartment 20, and a cold air supply device (not shown) configured to supply cold air to the storage compartment 20.

The cold air supply device may include a compressor, a condenser, an expansion valve, an evaporator, a blowing fan, a cold air duct, etc.

A machine room (not shown), in which the compressor configured to compress a refrigerant and the condenser configured to condense the compressed refrigerant are installed, may be provided at a rear lower side of the main body 10.

The main body 10 may include an inner case 11 forming the storage compartment 20, an outer case 12 coupled to the outside of the inner case 11 and forming an exterior of the main body 10, and an insulating material 19 foamed between the inner case 11 and the outer case 12 to insulate the storage compartment 20.

The cold air supply device may generate the cold air using a cooling circulation cycle including compression, condensation, expansion, and evaporation of the refrigerant.

The storage compartment 20 may be compartmentalized into an upper storage compartment 21 and a lower storage compartment 22 by a lateral partition 23. Although the refrigerator 1 according to one embodiment of the present invention may be a BMF type refrigerator in which the upper storage compartment 21 is a refrigerator compartment and the lower storage compartment 22 is a freezer compartment, the refrigerator 1 is not limited thereto, and the refrigerator 1 may be a TMF type refrigerator in which the upper storage compartment 21 is a freezer compartment and the lower storage compartment 22 is a freezer compartment. However, the refrigerator 1 may be described on the basis of a BMF type refrigerator for convenience of description.

In the upper storage compartment 21, shelves 24 on which food may be placed and a drawer 26 taken out from the upper storage compartment 21 and put into the upper storage compartment 21 by sliding may be provided. In the lower storage compartment 22, drawers 27 taken out from the lower storage compartment 22 and put into the lower storage compartment 22 by sliding may be provided.

A front surface of the storage compartment 20 may be open for putting in and take out food, and the open front surface may be opened and closed by the door 30.

The upper storage compartment 21 may be opened and closed by an upper door 31 rotatably connected to the main body 10. The lower storage compartment 22 may be opened and closed by a lower door 32 rotatably connected to the main body 10.

Door guards 35 capable of storing the food may be provided at a rear surface of the upper door 31.

The rear surface of the upper door 31 may include a guard support 35*a* configured to vertically extend to support at least one side of right and left sides of each of the door guards 35. Although the guard support 35*a* may be separably provided on the upper door 31 as a separate configuration, in the embodiment, the guard support 35*a* may be provided to extend from the rear surface of the upper door 31. A support holder 35*b* may be provided on the inside of the guard support 35*a* to support one side of the door guard 35.

The door 30 may include an inner case 30*a* forming an inner surface thereof, an outer case 30*b* forming an outer surface thereof, and an insulating material 39 foamed between the inner case 30*a* and the outer case 30*b*.

A gasket 36 may be provided at an edge of a rear surface of each of the upper door 31 and the lower door 32 to seal, in a state in which the upper door 31 and the lower door 32 are closed, a gap between the upper door 31 and the main body 10 and a gap between the lower door 32 and the main body 10. The gasket 36 may be installed in a loop shape along the edge of the rear surface of each of the upper door 31 and the lower door 32, and may include a magnet (not shown) therein.

The refrigerator 1 according to one embodiment of the present invention may further include a display unit 50 provided with input and output functions. The display unit 50 may be installed in the upper door 31 for user convenience. The door guard capable of storing the food may be provided on the rear surface of the door.

A speaker 40 may be provided in the main body 10 to output music or an alarm output from a controller (not shown). Further, a communication module 42 for communication with external appliances may be provided in an upper portion of the upper door 31.

The storage compartment 20 may include a plurality of storage portions 20*a*, 20*b*, and 20*c* (see FIG. 11) formed by at least one shelf. In the embodiment, although an example in which the storage compartment 20 includes first to third storage portions 20*a*, 20*b*, and 20*c* formed by a pair of shelves 24 is shown, the storage compartment 20 is not limited thereto.

FIG. 3 is a perspective view of a refrigerator door according to one embodiment of the present invention, and FIGS. 4 and 5 are views showing a disposition of a camera device of the refrigerator according to one embodiment of the present invention.

The refrigerator 1 may include a camera device 100. The camera device 100 is provided so that a state of the storage compartment 20 may be viewed from the outside of the refrigerator 1 without opening the door 30. Information of the storage compartment 20 recorded by the camera device 100 may be output by the display unit 50 provided in the refrigerator 1 or by an external communication appliance (not shown). Further, the information recorded by the camera device 100 may be stored in a storage device (not shown).

The camera device 100 may be mounted on the door 30. In detail, the camera device 100 may be separably installed on the inner surface of the door 30. Further, the camera device 100 may be formed to support one side of the door guard 35 configured to accommodate objects which are cooled.

FIGS. 6 and 7 are exploded perspective views of the camera device of the refrigerator according to one embodiment of the present invention.

The camera device 100 may include a housing 110 and at least one camera 160 mounted in the housing 110.

The housing 110 may be separably installed on the inner surface of the door 30. The camera 160 which will be described may be mounted in the housing 110. In the embodiment, although an example in which a plurality of cameras 160 are mounted in the housing 110 is shown, the camera 160 is not limited thereto. As an example, only one camera 160 may be mounted in the housing 110. Since at least one camera 160 is mounted in one housing 110, both of the housing 110 and the camera 160 may be modularized. The housing 110 may be formed in a plate shape having a predetermined width in a lateral direction and formed to be elongated in a vertical direction which is a longitudinal direction.

The housing 110 may be located on the inner surface of the door 30 to pass through a center of a width direction of the door 30. Further, the housing 110 may be located on the inner surface of the door 30 to correspond to a center of a width direction of the storage compartment 20. Since at least one camera 160 mounted in the housing 110 is located at the center of the width direction of the door 30 or at the center of the width direction of the storage compartment 20, the storage compartment 20 may be recorded without distortion.

The housing 110 may include a housing body 120, a housing cover 130, and a housing plate 140.

The camera 160 may be mounted on the housing body 120. In detail, the housing body 120 may include a camera seat groove 122 formed, in a front surface of the housing body 120 facing the storage compartment 20, to be more concave than the front surface of the housing body 120. The camera 160 may be seated in the camera seat groove 122. In the embodiment, since an example in which the plurality of cameras 160 are mounted is described, the camera seat groove 122 may be formed in plural. However, the camera 160 and the camera seat groove 122 are not limited thereto and only one of each may be provided.

The camera device 100 may include a printed circuit board 150 electrically connected to cameras 160. The printed circuit board 150 may be located inside the housing body 120. The housing body 120 has an opening 124 (see FIG. 7), of one open side, so that the printed circuit board 150 may be located therein.

The housing plate 140 is formed to cover the opening 124 of the housing body 120. Further, the housing plate 140 is configured to face the inner surface of the door 30, and as described below, the camera device 100 is configured to be mountable on the inner surface of the door 30 by sliding.

When the housing plate 140 is coupled with the open one side of the housing body 120, a sealing member may be added on a part in which the housing plate 140 and the housing body 120 are coupled. Since electric devices are disposed in the camera device 100, in order to prevent corrosion due to moisture and the like, the part in which the housing plate 140 and the housing body 120 are coupled may be sealed.

The housing cover 130 may be configured to cover the front surface of the housing body 120. On the front surface of the housing body 120, the housing cover 130 is configured to protect the housing body 120 and the cameras 160 mounted on the housing body 120. Further, since the housing cover 130 is formed to cover the front surface of the housing body 120, an aesthetic effect of the housing 110 is also improved. The housing cover 130 may include a plurality of camera holes 135 and 136 formed to be open so that lenses of the plurality of camera 160 may be exposed toward the storage compartment 20.

In the housing 110, the plurality of cameras 160 may be disposed to be spaced apart from each other. That is, the cameras 160 may be spaced apart from each other along the vertical direction which is the longitudinal direction of the housing 110 and mounted in the housing 110. The plurality of cameras 160 may be configured to record different areas of the storage compartment 20. The plurality of cameras 160 may be mounted in the housing 110 to face the plurality of storage portions 20*a*, 20*b*, and 20*c* (see FIG. 11) of the storage compartment 20, and may be configured to respectively record the plurality of storage portions 20*a*, 20*b*, and 20*c*.

The housing 110 may include a first surface 131 configured to extend in a vertical direction and a second surface 132 bent from the first surface 131 and formed to be inclined toward the inner surface of the door 30. The first and second surfaces 131 and 132 may be configured to face the storage compartment 20.

The plurality of cameras 160 may include at least one first camera 161 configured to be able to record through the first surface 131, and at least one second camera 162 configured to be able to record through the second surface 132. In detail, the plurality of camera holes 135 and 136 include at least one first camera hole 135 formed in the first surface 131 and at least one second camera hole 136 formed in the second surface 132, and then the first camera 161 is configured to record the storage compartment 20 through the first camera hole 135 and the second camera 162 is configured to record the storage compartment 20 through the second camera hole 136.

Since the second camera 162 is located inside the second surface 132 formed to be inclined from the first surface 131, all areas in the storage compartment 20 may be efficiently recorded without increasing a size of the camera device 100 or separating the camera device 100 from the door 30.

In the embodiment, a pair of first cameras 161 and one second camera 162 are provided to face the first to third storage portions 20*a*, 20*b*, and 20*c*, respectively. However, it is not limited thereto, and in the refrigerator 1, the number and locations of the cameras 160 may be changed according to the state of the storage compartment 20.

FIG. 8 is a cross-sectional view of A-A' in FIG. 5.

The door 30 may include a connection path 34. The connection path 34 is provided so that a connector 16 configured to electrically connect the camera device 100 and the controller (not shown) passes through the connection path 34.

The connection path 34 is configured to connect the inner case 30*a* and the outer case 30*b* of the door 30. A connector hole 33 is formed in the inner case 11 and is connected to one end of the connection path 34. In the embodiment, the other end of the connection path 34 is connected to an upper portion of the outer case 12 so as not to be exposed to the outside.

The connector 16 configured to pass through the connection path 34 and the connector hole 33 may pass through a plate hole 147 of the camera device 100 to be inserted into the inside of the camera device 100.

Although the insulating material 39 is foamed between the inner case 30*a* and the outer case 30*b*, the connector 16 is not influenced by the insulating material 39 since the connection path 34 connects the inner case 30*a* and the outer case 30*b*. Accordingly, damage of the connector 16 due to foaming of the insulating material 39 may be prevented, and the connector 16 may be easily removed and changed according to the attachment and detachment of the camera device 100. Further, as described above, since the connector 16 connected to the camera device 100 may be formed so as not to be exposed to the outside, the connector 16 may be protected from external influence, and an aesthetically pleasing effect may also be obtained.

FIGS. 9 and 10 are views in which the camera device of the refrigerator according to one embodiment of the present invention is mounted.

The camera device 100 may be rotatably mounted on the inner surface of the door 30. In detail, the camera device 100 may slide to be separably mounted on the inner surface of the door 30.

The door 30 may include holders 38 formed to protrude from the inner surface of the door 30. At least one holder 38 may be provided, and when the holder 38 is provided in plural, the plurality of holders 38 may be vertically arranged along a longitudinal direction of the camera device 100. The camera device 100 may be coupled to the holders 38 to be mounted on the inner surface of the door 30.

The holders 38 may be formed in a hook shape of which an end portion is formed to extend in an upward direction. As described above, the holders 38 may restrain the camera device 100 so that separation of the camera device 100 from the door 30 due to the weight of the camera device 100 may be prevented. In the embodiment, the plurality of holders 38 are provided, and the pair of holders 38 disposed on the inner surface of the door 30 to be spaced apart from each other in a lateral direction is configured to be arranged in a vertical direction. As described above, the camera device 100 may be stably mounted on the inner surface of the door 30.

The housing plate 140 may include insertion holes 142 into which the holders 38 are inserted and holder seat portions 146 on which the holders 38 are seated.

The insertion hole 142 may be formed in plural to correspond to the plurality of holders 38. In detail, the pair of insertion holes 142 spaced apart from each other in a lateral direction on the housing plate 140 may be configured to be arranged in a vertical direction.

The holder seat portion 146 is disposed adjacent to the insertion hole 142 so that the holder 38 is seated thereon. The holder seat portion 146 may be formed in plural to correspond to the plurality of insertion holes 142.

In the housing plate 140, the holder seat portion 146 may be located on the insertion hole 142 and may be formed on an inner surface of the housing plate 140.

The housing plate 140 may include a hook protrusion 144 formed to be inclined between the insertion holes 142 and the holder seat portion 146. When the camera device 100 slides, the holder 38 moves from the insertion hole 142 to the holder seat portion 146. In this process, the holder 38 is elastically deformed along the hook protrusion 144, and is seated on the holder seat portion 146 via the hook protrusion 144. The holder seat portion 146 is configured to be more concave than the hook protrusion 144 so that an end portion of the holder 38 may be seated thereon.

Referring to FIGS. 9 and 10, a process in which the camera device 100 is mounted on the door 30 will be described. As shown in FIG. 9, the camera device 100 is in close contact with the inner surface of the door 30 so that the plurality of holders 38 are respectively inserted into the plurality of insertion holes 142. Then, as shown in FIG. 10, when the camera device 100 slides, the holder 38 is elastically deformed by moving along the hook protrusion 144. The holder 38 is seated on the holder seat portion 146 via the hook protrusion 144. Accordingly, the camera device 100 is mounted on the inner surface of the door 30.

When the camera device 100 is mounted on the inner surface of the door 30, the camera device 100 may be screw-coupled to the door 30 by screws 105 to be fixed on the door 30. As shown in FIGS. 6 and 7, the housing 110 may include engage holes 127 to be screw-coupled to the door 30 by the screws 105. Since the camera device 100 is screw-coupled to the door 30 by the screws 105 through the engage holes 127, the camera device 100 may be fixed to the door 30.

The camera device 100 may be configured to support the door guard 35.

Referring to FIGS. 3 to 6, the camera device 100 is configured to support one side of the door guard 35.

In detail, the housing 110 may include a guard holder 126 formed on side surfaces of the camera device 100 so that the one side of the door guard 35 is mounted on the guard holder 126. The guard holder 126 may be formed to laterally protrude from the housing body 120. The door guard 35 includes a guard seat groove 36 having concavely formed side surfaces, to be seated on the guard holder 126.

The guard holder 126 may be formed on one side surface of the housing 110 and may also be formed on both side surfaces of the housing 110. At least one guard holder 126 may be provided on the housing body 120.

The door guard 35 and the camera 160 in the camera device 100 may be disposed to be spaced apart from each other in a vertical direction. Accordingly, the door guard 35 may be prevented from interfering with the lateral view angle of the camera 160.

In the embodiment, the door guard 35 includes a plurality of door guards 35 located on both surfaces of the camera device 100, and the guard holder 126 includes a plurality of guard holders 126 provided on both side surfaces of the housing 110 to support one sides of the plurality of door guards 35.

That is, the camera device 100 may be disposed to pass through the center of the width direction of the door 30, and may be mounted on the plurality of door guards 35 on both surfaces thereof.

The plurality of door guards 35 and the cameras 160 in the camera device 100 may be alternately disposed in a vertical direction. Accordingly, the door guards 35 may be prevented from interfering with the lateral view angles of the cameras 160.

FIG. 11 is a view of a vertical view angle of the camera device of the refrigerator according to one embodiment of the present invention, and FIG. 12 is a view of a lateral view angle of the camera device of the refrigerator according to one embodiment of the present invention.

In the embodiment, the storage compartment 20 may include the first to third storage portions 20*a*, 20*b*, and 20*c*. The pair of first cameras 161 are located to record the first and second storage portions 20*a* and 20*b*, and the second camera 162 is located to record the third storage portion 20*c*.

As shown in FIG. 11, the pair of first cameras 161 are configured to record the first and second storage portions through the pair of first camera holes 135 in the first surface 131 of the housing 110.

Further, the second camera 162 is configured to record the third storage portion 20*c* through the second camera hole 136 in the second surface 132 of the housing 110. Since the second surface 132 is bent from the first surface 131, the second camera 162 is positioned in a downward direction by a predetermined angle. Accordingly, the second camera 162 may record the third storage portion 20*c* located under the first and second storage portions 20*a* and 20*b*.

As shown in FIG. 12, the plurality of door guards 35 may be located at both sides of the plurality of cameras 160. Since the plurality of door guards 35 and the plurality of cameras 160 are alternately disposed in the vertical direction, the plurality of door guards 35 do not interfere with the lateral view angles of the cameras 160.

Hereinafter, a refrigerator according to another embodiment of the present invention will be described. Descriptions of components identical to above-described components will be omitted.

FIG. 13 is a perspective view of a refrigerator door according to another embodiment of the present invention, and FIG. 14 is an exploded perspective view of a refrigerator door according to another embodiment of the present invention.

A refrigerator 1 may include a camera device 200.

The camera device 200 may include a plurality of camera units 202, 203, and 204. The plurality of camera units 202, 203, and 204 may be separably mounted on an inner surface of a door 30. The plurality of camera units 202, 203, and 204 may be separably mounted on the inner surface of the door 30 by a sliding movement.

The plurality of camera units 202, 203, and 204 may include unit housings 210*a*, 210*b*, and 210*c*, and at least one camera 260*a*, 260*b*, and 260*c* respectively mounted in the unit housings 210*a*, 210*b*, and 210*c*. In the embodiment, although an example in which one camera is mounted in one camera unit is shown, the camera is not limited thereto, and a plurality of cameras may be mounted in one camera unit.

The camera device 200 may be formed to support door guards 35.

At least one among the plurality of camera units 202, 203, and 204 may include a guard holder 226 formed on a side surface thereof so that one side of the door guard 35 is mounted. The guard holder 226 may be formed to protrude from side surfaces of the unit housings 210*a*, 210*b*, and 210*c*. The door guard 35 includes a guard seat groove 36 having a concavely formed side surface to be seated on the guard holder 126.

Since the camera units 202, 203, and 204 are provided to be separable from the door 30, a storage compartment 20 may be recorded by omitting at least one camera unit among the plurality of camera units 202, 203, and 204 and mounting the remaining camera units. Further, instead of the omitted camera unit, a door guard 35 having a width corresponding to a width of the door 30 may be mounted on the door 30.

In the plurality of camera units 202, 203, and 204, the cameras 260 and the door guards 35 may be disposed to be spaced apart from each other in a vertical direction. Accordingly, the door guards 35 may be prevented from interfering with the lateral view angles of the cameras 160.

FIG. 15 is a perspective view of a refrigerator door according to still another embodiment of the present invention.

Hereinafter, a refrigerator according to still another embodiment of the present invention will be described. Descriptions of components identical to above-described components will be omitted.

A camera device 300 may be separably mounted on a door 30.

The camera device 300 may include a housing 310, and at least one camera 360 mounted in the housing 310.

The housing 310 may be formed in a plate shape having a predetermined height in a vertical direction and formed to be elongated in a lateral direction.

The at least one camera 360 is mounted in the housing 310 to record a storage compartment 20. In the embodiment, although an example in which a plurality of cameras 360 are mounted in the housing 310 is shown, the camera 360 is not limited thereto, and only one camera 360 may be mounted in the housing 310.

The plurality of cameras 360 may be spaced apart from each other along the lateral direction which is a longitudinal direction of the housing 310, and may be mounted in the housing 310.

Although a few embodiments of the present invention have been shown and described, it should be appreciated by those skilled in the art that changes may be made to the embodiments without departing from the principles and spirit of the present invention, and the scope of the present invention is defined in the claims and their equivalents.

The invention claimed is:

1. A refrigerator comprising:

a main body having at least one shelf and a plurality of storage portions partitioned by the at least one shelf;

a door having at least one door bin configured to accommodate an object which is cooled, the door to open and close the plurality of storage portions; and a camera device mounted on an inner surface of the door facing the plurality of storage portions, the camera device including:

at least one camera configured to photograph the plurality of storage portions; and a housing, in which the at least one camera is mounted, including at least one door bin holder formed on a side surface of the housing to support one side of the at least one door bin on the inner surface of the door, wherein the plurality of storage portions are arranged in a vertical direction, the housing includes:

a first surface configured to extend in a vertical direction; and a second surface bent from the first surface and configured to be inclined toward the inner surface of the door; and the at least one camera includes:

at least one first camera configured to photograph one storage portion among the plurality of storage portions through the first surface; and at least one second camera configured to photograph one storage portion located lower than the one storage portion among the plurality of storage portions through the second surface.

2. The refrigerator of claim 1, wherein the housing is removably provided at the inner surface of the door.

3. The refrigerator of claim 2, wherein the camera device is mounted on the inner surface of the door by a sliding movement.

4. The refrigerator of claim 3, wherein:

the door includes a holder formed to protrude from the inner surface of the door, and on which the camera device is mounted; and the housing includes:

an insertion hole, into which the holder is inserted, formed in one surface facing the inner surface of the door; and a holder seat portion disposed adjacent to the insertion hole, and configured so that the holder is seated thereon by the sliding movement of the camera device.

5. The refrigerator of claim 1, wherein the at least one camera device is disposed at a center of a width direction of the door.

6. The refrigerator of claim 1, wherein the at least one camera and the at least one door bin are alternately disposed with respect to a vertical direction.

7. The refrigerator of claim 1, wherein:

the at least one door bin holder includes a pair of door bin holders provided on both side surfaces of the housing; and the at least one door bin includes a pair of door bins disposed on both sides of the housing and having one side supported by the door and the other side supported by the pair of door bin holders.

8. The refrigerator of claim 7, wherein:

the plurality of door bins are vertically arranged; and the plurality of door bin holders vertically arranged on side surfaces of the housing to support one side of each of the plurality of door bins.

9. The refrigerator of claim 1, wherein the housing includes:

a housing body mounted on the inner surface of the door; and a housing cover having at least one camera hole formed so that the at least one camera is exposed toward the plurality of storage portions, and disposed on one side of the housing body.

10. The refrigerator of claim 1, wherein the housing includes a plurality of unit housings, in which the at least one camera is disposed, provided to be separable from each other.

* * * * *